US005332158A

United States Patent [19]

Styne et al.

[11] Patent Number: 5,332,158

[45] Date of Patent: Jul. 26, 1994

[54] SPRAYING DEVICE WITH AN INTERCHANGEABLE CARTRIDGE

[75] Inventors: James J. Styne, San Ramon; Michelle Pillers, Cupertino; Michael Greaney, Castro Valley, all of Calif.

[73] Assignee: Monsanto Company, St. Louis, Mo.

[21] Appl. No.: 992,386

[22] Filed: Dec. 16, 1992

[51] Int. Cl.[5] ..... B05B 7/30

[52] U.S. Cl. ..... 239/310; 239/317

[58] Field of Search ..... 239/310, 10, 317, 318, 239/375, 315; 222/85, 86, 32.5

[56] References Cited

U.S. PATENT DOCUMENTS

| | | | |
|---|---|---|---|
| Re. 18,813 | 5/1933 | Buchanan | 239/375 X |
| 2,719,704 | 10/1955 | Anderson et al. | 239/318 X |
| 3,447,753 | 6/1969 | Proctor et al. | 239/317 |
| 4,278,132 | 7/1981 | Hosfetter | 239/310 |
| 4,382,552 | 5/1983 | Lubsen et al. | 239/317 |
| 4,901,923 | 2/1990 | McRosleey et al. | 239/310 X |
| 5,213,264 | 5/1993 | Styne | 239/317 X |

FOREIGN PATENT DOCUMENTS

| | | | |
|---|---|---|---|
| 1132246 | of 0000 | France | 239/310 |

*Primary Examiner*—Andres Kashnikow
*Assistant Examiner*—Kevin Weldon
*Attorney, Agent, or Firm*—Gordon F. Sieckmann; Richard H. Shear; Stanley M. Tarter

[57] ABSTRACT

A spraying apparatus having a sprayer head and an interchangeable cartridge that can dilute and dispense a chemical is disclosed. A first fluid entering the sprayer head mixes with a second fluid that is drawn from the cartridge by aspiration to dilute the second fluid and the mixture is dispensed. The cartridge has an upper cap plate and a cap lid that rotate or slide with respect to each other, to allow easy installation and use, and safe storage of the cartridge for subsequent use. A rotatable valve can permit filling of the cartridge to a pre-selected degree of dilution.

13 Claims, 2 Drawing Sheets

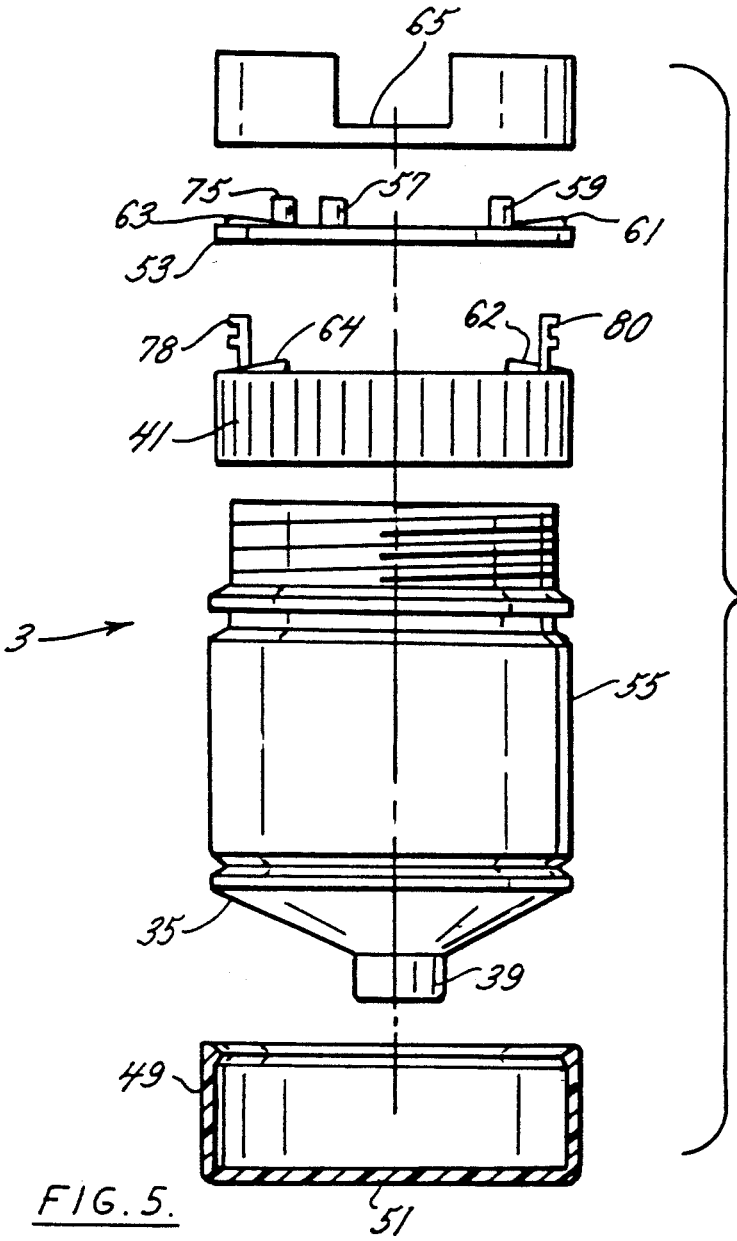
FIG. 4.
FIG. 5.
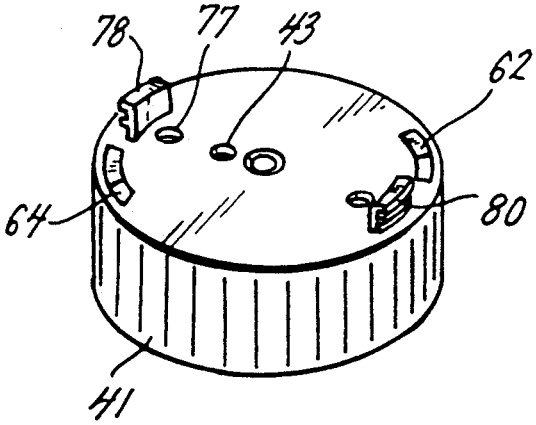
FIG. 6.
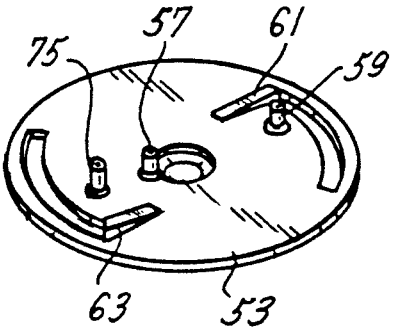

SPRAYING DEVICE WITH AN INTERCHANGEABLE CARTRIDGE

FIELD OF THE INVENTION

This invention relates to the field of lawn and garden chemical application. More specifically, the invention is an apparatus which dilutes and dispenses a chemical which is stored in an interchangeable and reusable cartridge.

BACKGROUND OF THE INVENTION

There are many spray gun type applicators known in the art of lawn and garden chemical application. Typical hose end lawn or garden sprayers are aspirator units which apply fertilizers, pesticides or other chemicals at a fixed, low dilution ratio. To utilize concentrates which must be diluted to high ratios, the user normally predilutes the concentrate with water. This is accomplished by volume measurement of the concentrate with a spoon, cap or other measuring device into a sprayer mix jar. Water is then added to obtain the proper premix concentration. The prediluted concentrate is then further diluted to its final dilution ratio as the sprayer is operated.

Such predilution procedures require the manual handling of concentrated chemicals with its attendant risks. Moreover, the user must generally purchase the concentrate in larger quantities than are necessary for a single application and thus containers of the concentrated chemical must be stored for extended periods after they have been opened. On the other hand devices which attempt to avoid predilution by diluting the concentrate at a high ratio in one (1) step are not satisfactory because of very poor accuracy. The concept of two-step mixing or dilution of chemicals, including such use in spraying devices is known. See, for example, U.S. Pat. Nos. 2,006,437; 2,599,678; 2,711,928; 2,760,820; 3,104,823; 3,181,797; 3,499,606; and 4,027,822. However, the devices shown in these patents are either cumbersome or otherwise unsuitable for garden spray devices.

U.S. Pat. No. 3,165,114 issued to Garret discloses a dispensing package of fluid soluble material capable of use with a standard feed mixer device. Some of the flowing water is diverted down through a nipple and inlet tube into the bottom of the package. Suction draws the dissolved material through an outlet tube. The device requires water to constantly flow through it, and does not provide a barrel valve which could shut off or control the flow.

U.S. Pat. No. 3,198,438 issued to Hultgren, et al. requires a trigger action to push a tapered plug out of an aperture, allowing water to flow into a mixing chamber to create a venturi suction to draw fluid out of a collapsible container. The device will not permit the use of a solid chemical, and does not have applicant's inventive use of a rotatable barrel valve to dilute a chemical or to control the discharge of the diluted solution into the environment. U.S. Pat. No. 3,255,972, also issued to Hultgren, et al. discloses a disposable container for use with sprayers of the type disclosed in the '438 patent.

U.S. Pat. No. 3,554,450, issued to D'Muhala teaches a spray gun which accommodates removable cartridges containing various solids or liquids. An end cap is unscrewed to control water through a mixing chamber and out a nozzle. The device does not provide for reusable cartridges, as each cartridge must be pierced to permit mixing with the water flow. There is no means to partially dilute a chemical, or to convert a solid chemical to a fluid prior to expulsion through the nozzle.

U.S. Pat. No. 3,915,191 discloses a water mixing device for a shower which may be fitted to the taps of a bath. A selector valve selectively permits water from an inlet chamber to flow through various enclosures of a second chamber. At least one (1) enclosure has a container to receive a soluble substance such as soap. No initial dissolution of the soap is provided for, and the soap is transported by direct flow of the water, and not drawn by aspiration.

U.S. Pat. No. 4,491,254 issued to Viets, et al. teaches an applicator for dispensing a chemical in dilute aqueous form. The applicator has two (2) containers. The second container receives a chemical which has been diluted with water from the first container. A two-position, rotatable valve directs the flow of water into either the first container to predilute a chemical, or to flow across an aspirator to mix with the prediluted chemical and discharge it through the exit end of a passageway. Viets' device requires removing caps from the containers to add chemicals, and to thread the containers together to attach them, a cumbersome and potentially dangerous procedure. The valve taught by Viets, et al. only has two (2) positions. Water is constantly flowing either into the second container to dilute a chemical or through the passageway. An operator must use a conventional nozzle, which must be specially adapted to attach to the applicator to turn the water on or off to control the flow.

U.S. patent application No. 595,523 (inventor—Styne and assigned to Applicant's assignee) has been granted an allowance by the U.S. Patent and Trademark Office, but has not yet issued at the time of filing this patent application. The patent that shall issue from U.S. Ser. No. 595,523 is hereby incorporated by reference for all purposes. Styne teaches a spraying apparatus having a sprayer head and a cartridge. A barrel valve controls whether an entering fluid flows directly into a mixing chamber, or flows through a tube into the cartridge, or does not flow at all. A membrane is required at the top of the cartridge, and is punctured by sprayer head tubes during attachment. Styne does not teach a device that ensures against leaks, that has a self-sealing, spill proof cartridge, or that permits an easy flow-control means.

The prior work is limited in the attempts to easily, economically, safely, and environmentally soundly provide a device to dilute and dispense various insecticides, herbicides, cleaners, and fertilizers. There is therefore a need for a spraying device that provides an operator with immediate flow control, and an interchangeable and reusable cartridge that is quick and easy to attach to a sprayer head, that minimizes leaks, and is safe to use.

SUMMARY OF THE INVENTION

The present invention is a spraying apparatus having a sprayer head and an interchangeable cartridge. A fluid inlet conduit directs flow into a mixing conduit. An aspirator port connects the mixing conduit with a second fluid in the cartridge so that the second fluid is drawn from the cartridge and mixes with the first fluid and is discharged into the environment. A vent port in the sprayer head connects with a vent in the cartridge to reduce the pressure differential to allow proper aspiration and to reduce leaks. A nozzle means permits a controlled jet spray.

The cartridge containing the second fluid has a housing having a cap lid which has an aspirator opening and a vent opening. A dip tube extends downward from the cap lid nearly to the bottom end of the cartridge housing. An upper cap plate is rotatably or slidably attached to the cap lid. The upper cap plate has an aspirator nipple and a vent nipple that align and sealably communicate with the aspirator opening and the vent opening upon rotation or sliding. The cartridge is attachable to the sprayer head in a manner which prevents leaks when the cartridge is not in use, and allows cartridge re-use.

BRIEF DESCRIPTION OF THE DRAWINGS

FIG. 4 is a schematic, broken side view of the cartridge.

FIG. 5 is a schematic top/side view of the cap lid.

FIG. 6 is a schematic top/side view of the upper cap plate.

DETAILED DESCRIPTION OF THE INVENTION

In accordance with the present invention, a new improved method and apparatus for diluting and dispensing a chemical, which is stored in an interchangeable, replaceable and recyclable and/or biodegradable cartridge, has been developed.

Figure 1:
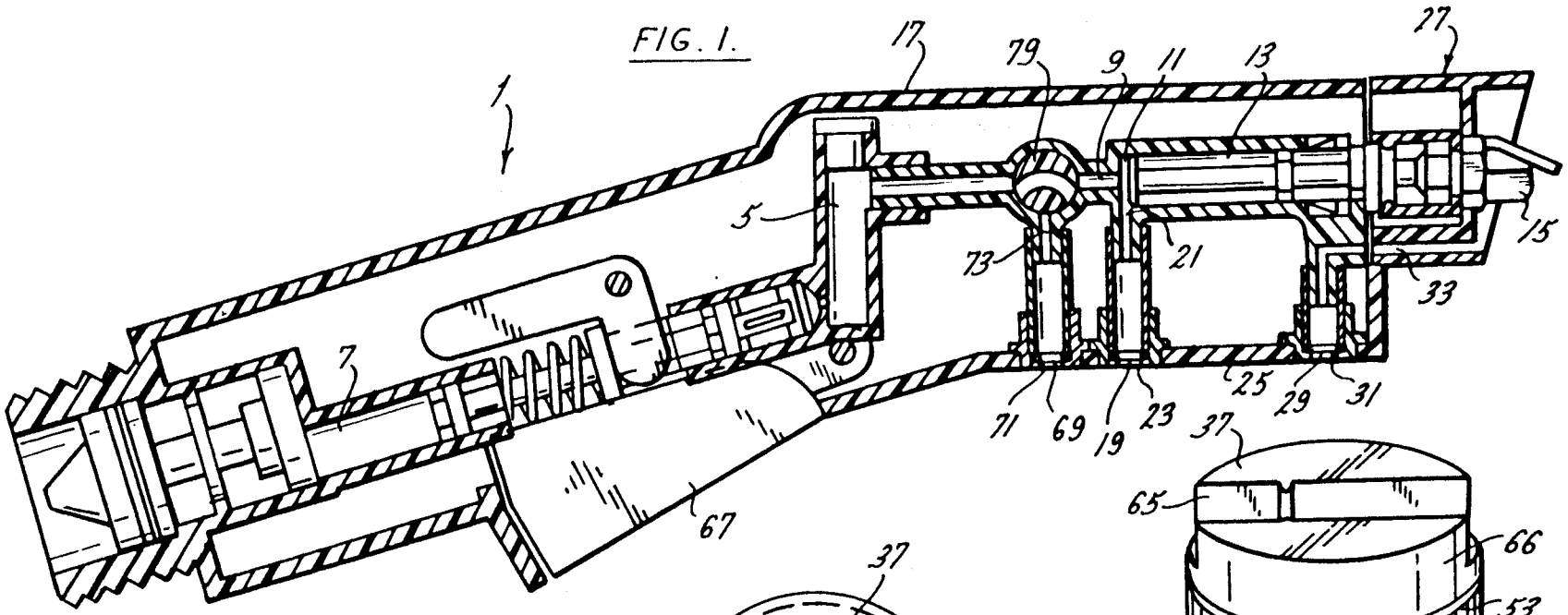
FIG. 1 is a schematic side sectional view of one embodiment of the sprayer head of the spraying device.
Figure 2:
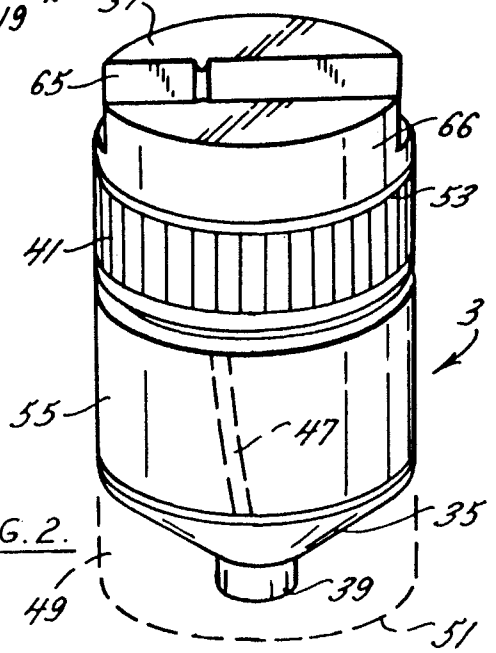
FIG. 2 is a schematic top/side view of one embodiment of the cartridge of the spraying device.

Referring to FIGS. 1 and 2, a first embodiment of the device comprises two (2) main components, a sprayer head 1 and an interchangeable cartridge 3. In the preferred embodiment, the cartridge 3 is replaceable and disposable. In another embodiment, the cartridge is recyclable and/or biodegradable.

In one embodiment of the invention, a fluid inlet conduit 5 having a first end 7 and a second end 9 directs a first fluid such as water into the sprayer head 1 at the first end 7, and to the first open end 11 of the mixing conduit 13. In the preferred embodiment, a hose-nut fitting means is disposed near the first end 7 of the fluid inlet conduit 5 to reduce any leakage from a source of the first fluid such as a garden hose, that enters the fluid inlet conduit. Anti-siphon hose-nut fittings are well known in the art and are especially useful for preventing back flow and leaking from the first end 7 of the fluid inlet conduit 5.

The first end 11 of the mixing conduit 13 is in fluid communication with the second end 9 of the inlet conduit 5. The second end 15 of the mixing conduit extends through a housing 17. The housing 17 provides support to the sprayer head 1 to enhance fluid flow through the referenced conduits, ports, and other passages. Any suitable material, such as plastic, may comprise the housing 17.

An aspirator port 19 has a first open end 21 that is in fluid communication with the mixing conduit 13. A second open end 23 of the aspirator port 19 extends through the bottom edge of the housing 17 so that when the first fluid is directed to enter the first end 7 of the fluid inlet conduit 5, the first fluid can draw a second fluid through the aspirator port 19 into the mixing conduit 13 by aspiration. The resulting mixed fluid is then discharged through the second end 15 of the mixing conduit 13 into the environment. The second fluid can be any fluid that when diluted with the first fluid, becomes suitable for discharge into the environment for any of several uses, such as a pesticide, herbicide, insecticide, waxing or washing product, engine cleaner, road surface cleaner, or fertilizer.

In the preferred embodiment, the spraying apparatus also has a nozzle means 27 which provides a jet spray. It is desirable that the nozzle means 27 be adjustable to spray up or down or to selectively provide a jet spray. Nozzle means are well known in the art.

In one embodiment, a vent port 29 has an open, lower end 31 that extends through the bottom edge 25 of the housing 17 in nearly the same direction as first end 21 of the aspirator port 19. In the preferred embodiment, both the lower end 31 of the vent port and the first end of the aspirator port both open in a downward direction, through the bottom edge 25 of the housing, to facilitate easy coupling with a supply of the second fluid, such as a cartridge 3. An open, intake end 33 of the vent port 29 extends through the housing 17 so that when the second fluid is drawn through the aspirator port 19, the vent port 29 allows air to flow therethrough to reduce any pressure differential created, to allow proper aspiration and discharge, and to allow dilution of the second fluid, prior to aspiration, if desirable.

In the preferred embodiment, the open intake end 33 of the vent port 29 extends through the housing 17 to a location near the nozzle means 27 to ensure that any fluid flowing from the source of the second fluid (such as a cartridge 3), through the vent port 29 is discharged into the environment. This helps to prevent unwanted spills and leakage should the spraying apparatus become tipped, as the vented material exits near an expected location (i.e. through or at the nozzle means).

The cartridge 3 is an especially useful device for containing the second fluid therein. As shown in FIGS. 2–6, the cartridge 3 has a cartridge housing 35 for containing the second fluid which has a top end 37 and a closed bottom end 39. The cartridge 3 can be comprised of any suitable material, such as plastic. It is desirable that the cartridge 3 be comprised of a recyclable and/or biodegradable material.

A cap lid 41 is fixedly attached to the cartridge body 55 of the cartridge housing 35. As shown in FIG. 5, the cap lid 41 has an aspirator opening 43 and a vent opening 45. The cap lid 41 is attached to the cartridge body by any of several means known in the art. In the preferred embodiment, the cap lid 41 is threadably attached to the cartridge body 55.

A dip tube 47, that is open at both ends, is connected to and in fluid communication with the aspirator opening 43 and extends downward from the cap lid 41 nearly to the bottom end 39 of the cartridge housing 35. In one embodiment, the cartridge housing 35 is tapered so that the bottom end has a smaller diameter than the top end 37, to form a depression at the bottom end 39, to maximize the amount of the second fluid that can be drawn from the cartridge 3 up through the dip tube 47 and through the aspirator opening 43. In the preferred embodiment, over 99% recovery of the diluted second fluid is attained. In the preferred embodiment, an outer cartridge housing 49 surrounds the amount of the cartridge housing 35 necessary for the outer cartridge housing to form a nearly flat bottom edge Such flat bottom edge 51 enables the cartridge 3 to sit flat, whether or not attached to the sprayer head 1.

Figure 3:
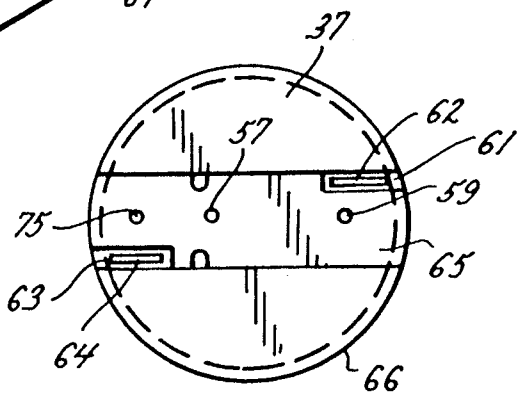
FIG. 3 is a schematic top view of one embodiment of the cartridge.

An upper cap plate 53 is either rotatably attached to the cap lid 41 near the center of both by any of several means, such as a swivel or rivet, or bolt known in the art, so that the cap lid 41 and cartridge body 55 can rotate in a clockwise or counterclockwise direction in relationship to the upper cap plate 53 as shown in FIG. 3, or the cap plate 53 and cap lid 41 are slidably attached to each other by means known in the art. The upper cap plate has an aspirator nipple 57 and a vent nipple 59 that align with and sealably communicate with the aspirator opening 43 and the vent opening 45 respectively of the cap lid upon a specified degree of rotation or sliding. In the preferred embodiment, the upper cap plate 53 has an oriface, whereby the size of which controls the amount of dilution and/or mixing of the second fluid. The aspirator nipple 57 is an especially useful oriface. The aspirator nipple 57 is sealably mateable to the second end of the aspirator port 19 of the sprayer head 1 and the vent nipple 59 is sealably mateable to the lower end 31 of the vent port 29 of the sprayer head 1.

The aspirator nipple 57 and vent nipple 59 can mate with the aspirator port 19 and vent port 29 by any of several known means. One especially useful means is for the aspirator nipple 57 and vent nipple 59 to be comprised of an elastomeric material and function as male components that mate with the aspirator port and vent port which function as female components.

In the preferred embodiment, the upper cap plate 53 is selectively prevented from rotating or sliding with respect to the cap lid 41. An especially effective means of preventing such rotation or sliding, until a time when such rotation or sliding is desired, is to attach at least one biased lever means on the top of the upper cap plate 53 so that rotation or sliding is prevented until the cartridge 3 is attached to the sprayer head 1. In the preferred embodiment, a pair of levers 61 and 63 are biased to an upward position and are connected to a locking means that prevents movement of the cap plate and lid until they are depressed. Attaching the cartridge 3 to the sprayer 1 depresses the levers and unlocks the cap plates to allow rotation or sliding. In the preferred embodiment, the levers 61 and 63 on the upper cap plate 53 are biased upward by a set of tabs 62 and 64 on the cap lid 41. Depressing the levers also depresses the tabs, thereby releasing the upper cap plate from the cap lid.

The cartridge 3 can be attached to the sprayer head 1 by any of several means known in the art. In the preferred embodiment, as shown in FIGS. 2 and 3, the upper cap plate 53 has a shroud 66 having a groove 65 which enables the upper cap plate 53 to be maintained in a fixed position when attached to the sprayer head 1. It is desirable that the shroud 66 further have a directional guide means to ensure proper sprayer head-cartridge orientation. When brought together, the second end of the aspirator port 19 mates with the aspirator nipple 57 and the lower end 31 of the vent port 29 mates with the vent nipple 59. The levers 61 and 63 are depressed, releasing the cap lid 41 to be able to rotate or slide with respect to the upper cap plate 53. In the preferred embodiment, the upper cap plate 53 has a locking means to prevent unwanted sliding or rotation during use. As shown in FIG. 5, a pair of locking tabs 78 and 80 that are mateable with the cap lid 41 are an especially useful locking means.

In the preferred embodiment, upon attachment of the sprayer head 1 to the cartridge, rotation or sliding of the cap lid 41 enables the aspirator nipple 57 to align with the aspirator opening 43 and the vent nipple 59 to align with the vent opening 45. The positions of the aspirator nipple and vent nipple can be set relative to the aspirator opening and vent opening to allow for any selected amount of rotation or sliding needed to result in alignment. A rotation of about ⅛ of the circumference of the cartridge is especially desirable to enhance ease of use, as shown in FIG. 5. When the operator is finished, the cartridge 3 can be removed. The cap plates can be biased to automatically rotate or slide back to their original sealed position and thus are spill-resistant. The cartridge can then be safely stored until subsequent use.

An actuating means allows a controlled amount of the first fluid to flow through the fluid inlet conduit 5. In the preferred embodiment, a trigger means 67 serves as an on-off valve. Such trigger means are well known in the art.

In another embodiment of the inventive spraying device, the sprayer head 1 further comprises a rotatable valve that is biased to a first, fill position so that a controlled amount of the first fluid is directed to flow through a filler port 69 having a distal open end 71 and an open rear end 73. The distal end 71 extends through the bottom edge of the housing in nearly the same direction as the aspirator port and the vent port 29. The first fluid is directed to flow through a filler nipple 75 of the upper cap plate 53 and through a filler opening 77 of the cap lid 41, if the cap plate and lid are rotated or slid into their aligned position. Flow through the filler port, filler nipple, and filler opening continues until the cartridge housing 35 is sufficiently filled to obtain a proper degree of dilution or mixing. In this first, fill position, the valve means blocks flow of the first fluid through the aspirator port 19 to prevent aspiration of the partially diluted second fluid.

Upon reaching the desired amount of first fluid added to the cartridge housing 35, the valve can be moved to a second, flow position, where the filler port 69 receives no more flow, and the aspirator port 19 is opened to allow flow therethrough. The valve and filler port are particularly useful if a dry chemical is initially in the cartridge housing 35 or if the second fluid needs to be diluted. In the preferred embodiment, a manually operated diverter valve 79 is an especially useful valve. These are well known in the art.

In operation, a cartridge 3 is attached to a sprayer head 1 by a means such as snapping, which has been connected to a source of a first fluid such as a garden hose. By activating a trigger means 67, the first fluid is directed to flow through the fluid inlet conduit 5 and to the valve 79. If the cartridge contains a dry chemical or if further dilution is necessary, the first fluid can be directed down a filler port 69 and into the cartridge to cause proper dilution of the chemical therein. Upon proper dilution, the valve 79 can be moved to a second, flow position where the first fluid now flows into a mixing conduit 13 and causes the second fluid to also flow through the aspirator port 19 into the mixing conduit via aspiration where it is further diluted and is discharged into the environment. The nozzle means 27 allows a controlled jet spray flow therefrom. A vent port 29 allows enhanced filling of and removal from the cartridge without leakage, due to maintenance of a proper pressure differential. When finished, the cartridge can be easily removed, for example by rotating or sliding it off. It automatically seals upon removal and can be stored for subsequent use.

The inventive spraying device has several advantages. It is designed to be easy to use, as no separate mixing of chemicals is required. The cartridge minimizes leaks and can be removed and safely stored. Flow control is immediate, and cartridges can be interchanged without having to remove the sprayer head. Cartridges can be used whether or not the chemical therein requires mixing or dilution.

While a preferred embodiment of the invention has been described and illustrated, it should be apparent that many modifications can be made thereto without departing from the spirit or scope of the invention. Accordingly, the invention is not limited by the foregoing description, but is only limited by the scope of the claims appended hereto.

WHAT IS CLAIMED IS:

1. A spraying apparatus comprising:

a spraying head further comprising:

a fluid inlet conduit having a first end and a second end;

a mixing conduit having a first open end in fluid communication with said second end of said fluid inlet conduit and a second open end extending through a housing;

an aspirator passage having a first, open end in communication with said mixing conduit and a second open end extending through the bottom edge of said housing so that when a first fluid is directed to enter said first end of said fluid inlet conduit, said first fluid can draw a second fluid through said aspirator passage into said mixing conduit, and that a resulting mixed fluid is discharged through said second end of said mixing conduit into the environment, said housing sealed to permit flow only through said conduits and passage; and an interchangeable cartridge containing said second fluid therein, said cartridge further comprising:

a cartridge housing for containing said second fluid therein, having a top end and a closed bottom end;

a cap lid fixedly attached to said cartridge housing, said cap lid having an aspirator opening and a vent opening;

a dip tube, open at both ends, connected to and in communication with said aspirator opening and extending downward from said cap lid nearly to said bottom end of said cartridge housing;

an upper cap plate rotatably attached to said cap lid, said upper cap plate having an aspirator nipple and a vent nipple that align with and sealably communicate with said aspirator opening and said vent opening respectively upon rotation, said aspirator nipple sealably mateable to said aspirator passage and said vent nipple sealably mateable to a vent passage; and a means for attaching said cartridge to said sprayer head.

2. The spraying apparatus of claim 1 further comprising a vent port having a lower open end extending through said bottom edge of said housing in nearly the same direction as said aspirator passage first end, and an open intake end extending through said housing so that when said second fluid is drawn through said aspirator passage said vent passage allows air to flow therethrough to reduce any undesired pressure differential created.

3. The spraying apparatus of claim 1 wherein said upper cap plate is slidably attached to said cap lid so that said nipples align with said openings upon sliding.

4. The spraying apparatus of claim 1 wherein said sprayer head further comprises a rotatable valve that can be moved to a fill position so that a controlled amount of said first fluid is directed to flow through a filler passage having a distal open end extending through said bottom edge of said housing, and into said cartridge, where said cap lid further comprises a filler opening, and said upper cap plate further comprises a filler nipple that aligns with said filler opening upon rotation and said filler nipple sealably mateable to said filler passage, and to a flow position where said first fluid flows from said inlet conduit directly to said mixing chamber.

5. The spraying apparatus of claim 1 further comprising an actuating means that allows an amount of said first fluid to flow through said fluid inlet conduit.

6. The spraying apparatus of claim 1 further comprising a means to selectively prevent said upper cap plate from moving, with respect to said cap lid.

7. The spraying apparatus of claim 6 wherein said upper cap plate movement is prevented from rotating by at least one lever means which allows said movement when said cartridge is attached to said sprayer head.

8. The spraying apparatus of claim 1 further comprising a nozzle means which provides a jet spray.

9. The spraying apparatus of claim 1 further comprising a hose-nut fitting means disposed near said first end of said fluid inlet conduit to reduce any leakage from a source of said first fluid entering said fluid inlet conduit.

10. The spraying apparatus of claim 1 wherein said cartridge housing is tapered so that said bottom end of said cartridge housing has a smaller diameter than said top end of said cartridge housing to maximize the amount of said second fluid that can be drawn through said aspirator passage.

11. The spraying apparatus of claim further comprising an outer cartridge housing that surrounds said cartridge housing and has a nearly flat bottom edge.

12. The spraying apparatus of claim 1 wherein said open intake end of said vent passage extends to and communicates with said mixing conduit near said second end of said mixing conduit to ensure that any fluid flowing from said cartridge through said vent nipple is discharged through said mixing conduit.

13. The spraying apparatus of claim 7 wherein said lever means comprises a pair of levers disposed on said upper cap plate and a corresponding set of tabs disposed on said cap lid whereby said tabs bias said levers upward, so that when said cartridge is attached to said sprayer head, said levers are depressed, thereby depressing said tabs which releases said upper cap plate from said cap lid.

* * * * *